US006511701B1

(12) United States Patent
Divigalpitiya et al.

(10) Patent No.: US 6,511,701 B1
(45) Date of Patent: Jan. 28, 2003

(54) COATINGS AND METHODS

(75) Inventors: Ranjith Divigalpitiya, London (CA); Gabriella Miholics, London (CA); David C. Chambers, Ilderton (CA)

(73) Assignee: 3M Innovative Properties Company, St Paul, MN (US)

( * ) Notice: Subject to any disclaimer, the term of this patent is extended or adjusted under 35 U.S.C. 154(b) by 0 days.

(21) Appl. No.: 09/567,142

(22) Filed: May 9, 2000

(51) Int. Cl.[7] ..... B05D 1/28; B05D 1/36

(52) U.S. Cl. ..... 427/11; 427/404; 427/407.1; 427/419.7; 427/256; 427/258; 427/261

(58) Field of Search ..... 427/11, 404, 407.1, 427/419.7, 256, 258, 261

(56) References Cited

U.S. PATENT DOCUMENTS

| | | | | | |
|---|---|---|---|---|---|
| 3,266,113 | A | * | 8/1966 | Flanagan | 24/204 |
| 3,369,268 | A | * | 2/1968 | Burns et al. | 15/210 |
| 3,857,206 | A | * | 12/1974 | Heffran, Jr. | 451/357 |
| 4,477,198 | A | * | 10/1984 | Bowlds et al. | 400/120 |
| 4,539,256 | A | * | 9/1985 | Shipman | 528/315.5 |
| 4,741,918 | A | * | 5/1988 | De Nagybaczon et al. | 427/11 |
| 4,822,194 | A | | 4/1989 | Simonette | |
| 4,894,060 | A | * | 1/1990 | Nestegard | 604/391 |
| 5,077,870 | A | * | 1/1992 | Melbye et al. | 24/452 |
| 5,368,890 | A | * | 11/1994 | De Nagybaczon | 427/249 |
| 5,505,747 | A | * | 4/1996 | Chesley et al. | 51/297 |
| 5,657,516 | A | * | 8/1997 | Berg et al. | 24/452 |
| 5,723,168 | A | * | 3/1998 | Swain et al. | 427/11 |

FOREIGN PATENT DOCUMENTS

| | | | | |
|---|---|---|---|---|
| CA | 1 252 005 | * | 4/1989 | B05D/1/28 |
| GB | 2 270 574 | * | 3/1994 | G03G/5/05 |
| WO | WO94/23610 | * | 10/1994 | A44B/18/00 |
| WO | WO 94/25641 | * | 10/1994 | C23C/24/02 |
| WO | WO94/25641 | * | 11/1994 | C23C/24/02 |
| WO | WO 95/30493 | | 11/1995 | |
| WO | WO 96/30129 | | 10/1996 | |

OTHER PUBLICATIONS

Kirk–Ohmer, "Fuel Resources to Heat Stabilizers", *Encyclopedia of Chemical Technology*, Fourth Edition, vol. 12, pp. 926–927.*

Yen, Shiao–Ping, et al., "Cheaper Polymeric Electrolyte Membranes for Fuel Cells" *NASA Tech Briefs*, p. 56, (Oct. 1999).*

* cited by examiner

*Primary Examiner*—Shrive P. Beck
*Assistant Examiner*—Jennifer Kolb Michener
(74) *Attorney, Agent, or Firm*—Dale A. Bjorkman; Lucy C. Weiss

(57) ABSTRACT

A method of coating a polymer substrate with a dry composition comprising particles is provided. The particles have a Mohs hardness between 1 and 2.5 and preferably a largest dimension of less than 100 microns. The particles are buffed on the substrate with an applicator which moves in a manner parallel to the surface of the substrate.

40 Claims, 7 Drawing Sheets

COATINGS AND METHODS

FIELD OF THE INVENTION

The present invention relates to coatings on polymer substrates. More specifically, the present invention relates to thin coatings on polymer substrates that are applied with low energy, and methods of coating polymer substrates.

BACKGROUND OF THE INVENTION

A multitude of thin coating techniques have been disclosed in the prior art, including sputter coating, physical vapor deposition, melt extrusion, solvent deposition and high energy buffing. These techniques have disadvantages in requiring highly specialized equipment or involving the evaporation of volatile organic solvents (VOC's) that may be a source of pollution. Alternatively, these techniques may require the input of large amounts of energy. Further, many of these techniques do not provide a satisfactorily thin and uniform coating, and may change the morphology of the material to be coated in an unsatisfactory manner.

U.S. Pat. No. 4,741,918 to de Nagybaczon, et al. discloses a coating process wherein dry particles are coated on a substrate with a high-energy buffing wheel. Because a buffing wheel is used, this process inherently orients the particles in the direction of travel of the buffing wheel on the substrate. The coating of this disclosure is described as having a characteristic "smeared appearance" at column 3, lines 49–50.

In the prior art on high energy buffing all previous methods disclose only a rotary motion of an applicator pad with the rotational axis parallel to the plane of the substrate or the web.

SUMMARY OF THE INVENTION

A method of coating a polymer substrate with a dry composition comprising particles is provided. The particles have a Mohs' hardness between 1 and 2.5 and a largest dimension of less than 100 microns. The particles are buffed on the substrate at a pressure of less than about 30 g/cm$^2$ with an applicator which moves in a manner parallel to the surface of the substrate. When the particles have one dimension longer than other dimensions, the particles are randomly oriented in the plane of the substrate. The composition preferably contains no materials in an amount effective to act as a binder.

DETAILED DESCRIPTION OF THE INVENTION

Figure 1:
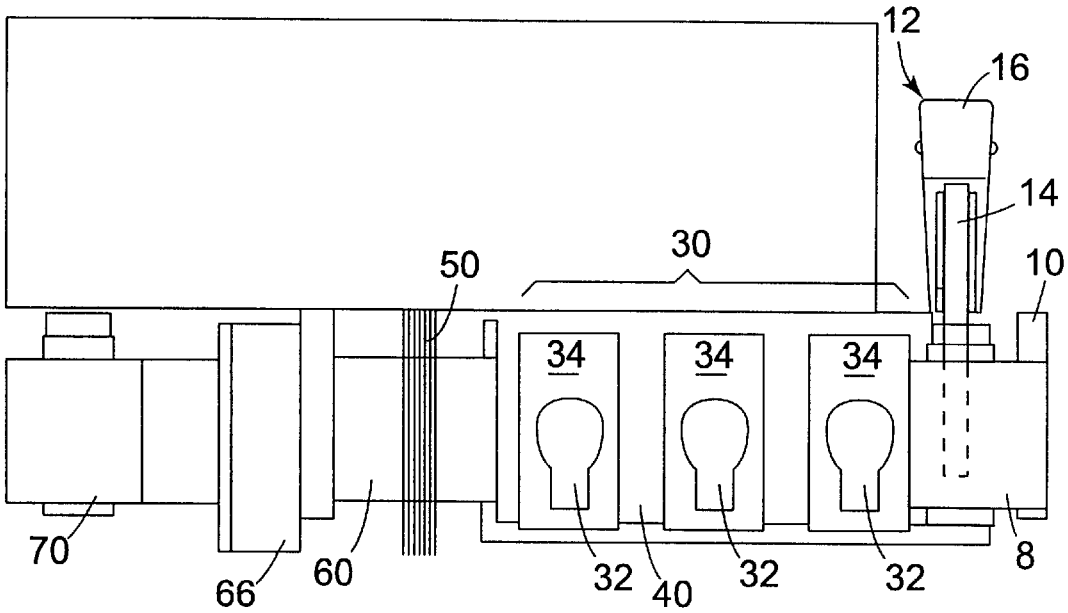
FIG. 1. is a plan view of a web coating line of the present invention.

For purposes of the present invention, "uniform" means having a relatively consistent thickness of coating over the desired dimension of the article in the plane of the substrate. The uniformity of the coating may be evaluated, for example, by optical evaluation using an optical densitometer. To evaluate uniformity, a transmission reading (or, alternatively, reflectance) is taken at six points and compared to determine the variation. Preferably, the variation is no more than 10%, more preferably no more than 5%, and most preferably no more than 3%. The wavelength to be evaluated is dependent on the physical properties of the coating and of the substrate and is appropriately selected to accurately assess the uniformity of the coating. For example, a coating that is visible under ordinary light conditions is evaluated using a wavelength of light in the visible range, such as 550 nm, the generally accepted midpoint of visible light.

For purposes of the present invention, "dry" means substantially free of liquid. Thus, in the process of the present invention the composition is provided in a solid form, rather than in a liquid or paste form. Surprisingly it has been found that the use of dry particles that are not provided in a liquid or paste format is essential to obtaining this uniformity, because non-uniformity is introduced by evaporation of the liquid carrier of liquid or paste compositions.

Mohs' hardness is a scale indicating the hardness of a material. The hardness of the particles of the present invention is established as the Mohs' scale hardness of the material in bulk. Mohs' hardness values are widely reported in the literature, including the CRC Handbook of Chemistry and Physics, and the Kirk-Othmer Encyclopedia of Chemical Technology. Particles of a material having a Mohs' hardness between 0.4 and 3 are considered to be "buffable" for purposes of the present invention. This is not to say that other materials not meeting this definition cannot be incorporated into coatings of the present invention. Rather, a "buffable" particle is defined herein as a particle that can be effectively coated on a polymer substrate as a homogeneous composition through buffing.

Articles of the present invention are also contemplated where the coating is masked or otherwise adapted so that the coating is located only at selected regions of the substrate. Additionally, coatings may be varied in thickness at some regions to provide a differential pattern as desired.

Generally, the coatings of the present invention are less than 3 microns in thickness. Preferably, the coatings are less than about 1,000 nm thick and more preferably less than 200 nm thick.

The polymer substrate on which the coatings are to be applied are any polymeric materials. A preferred class includes porous or microporous polymers membrane, such as disclosed in U.S. Pat. No. 4,539,256 (Shipman). Alternatively, the polymer substrate may be tacky or adhesive in nature. Preferred materials include acrylate adhesives, rubber adhesive, epoxy adhesives and the like. Particularly preferred polymer substrates are non-porous polymeric substrates, including polyester, polypropylene, polyethylene, polystryrene, polycarbonate, polyvinylchloride, polyimide, polymethyl methacrylate, and polyvinyl chloride. The substrate may be relatively smooth in nature, or alternatively may be provided with macro or micro geometry. A preferred surface geometry includes grooves, channels, posts or the like having depths of about 10–2000 microns and width of between 10–2000 microns. Additionally, shapes such as mushrooms, hooks, etc. having undercuts are particularly preferred. Examples of such geometries are provided in U.S. Pat. Nos. 3,266,113; 5,077,870; 5,505,747; 4,894,060; 5,657,516 and WO 94/23610, the disclosures of which are hereby incorporated by reference. A particularly preferred embodiment has a mushroom shaped head and stem with circular cross-section. For this embodiment, the preferred heights of the stems as measured from a first major surface of the substrate to the bottom of the head are in the range of 0.002 to 0.500 inch (0.005 to 1.27 cm). Preferred heights of the heads as measured from the bottom of the head to the top of the head are in the range of 0.002 to 0.215 inch (0.008 to 0.178 cm). Preferred diameters of the stems are in the range of 0.003 to 0.070 inch (0.008 to 0.178 cm). Preferred diameters of the heads at their outermost periphery are in the range of 0.005 to 0.150 inch (0.013 to 0.381 cm). Density of headed stems on a planar surface is typically about 300–2500 headed stems per square inch.

The particles to be coated on the substrates include carbon black, PTFE ("Teflon," polytetrafluoroethylene), PVDF ("Kynar," polyvinylidene difluoride), sulfur, tungsten disulfide, polytetrafluoroethylene, polyvinylidene difluoride, ULTEM™ oligomer (polyetherimide resin), zeolites (particularly silver zeolites), l-ascorbic acid (vitamin C), silver chloride (AgCl), silver sulfadiazine, and various amino acids.

Particularly preferred particles are exfoliatable particles. For purposes of the present invention, the term "exfoliatable particle" means a particle that breaks up into flakes, scales, sheets or layers upon application of shear force. Particularly preferred exfoliatable materials include graphite, $MoS_2$ (molybdenum disulfide), $WS_2$ (tungsten disulfide), clays and h-BN(hexagonal boron nitride).

Preferred coatings comprise a combination of non-exfoliatable particles with exfoliatable particles.

In a particularly preferred embodiment of the present invention, exfoliating particles are combined with buffing aid particles that have a dimensional aspect ratio of about 1. Preferably, the buffing aid particles are spherical. The buffing aid particles preferably have an average largest dimension of between about 0.1–10 microns. More preferably the average largest dimension is between about 0.5–2 microns. Most preferably, the buffing aid particles have an average largest dimension in the same order of magnitude as the average largest dimension of the exfoliatable particle. The use of buffing aid particles surprisingly improves the appearance and uniformity of the coating. This is particularly advantageous in the case of optical coating applications, such as window film, neutral density filters, mirror applications and the like. Such embodiments may exhibit low haze and high optical clarity properties.

In one embodiment of the present invention, the buffing aid particles preferable have a low affinity for the substrate to be coated and a low affinity for the exfoliatable particles. A particle is considered to have a low affinity for a substrate if the particles will not stay on the substrate by themselves if buffed on the substrate using the methods of the present invention. Such buffing aid particles tend to separate from the exfoliatable particles during the buffing process, and help the distribution and uniformity of the exfoliatable particles on the substrate. Little or no buffing aid particles remain on the final coated product. Examples of such buffing aid particles include Radiant® MP series encapsulated dye particles from Radiant Color Co. (Richmond, Calif.), such as magenta, MP orange, MP chartreuse, and clear particles. Other buffing aid particles include Methyl red dye particles having a CAS number of 493-52-7, Methylene blue dye particles having a CAS number of 75-09-2, Perylene Red pigment, Rhodamine B dye having a CAS number of 81-88-9, Malachite green oxalate having a CAS number of 2437-29-8, and Azure A dye having a CAS number of 531-53-3.

Preferably, magnetic toner particles may also be used as the buffing aid particles. These particles are particularly advantageous, because excess particles can be easily removed from the work area with a magnet.

In an alternative embodiment, the buffing aid particles have at least some affinity for the exfoliating particles. In this embodiment, the buffing aid particles in addition to assisting in the distribution and uniformity of the coating of exfoliating particles are themselves incorporated into the coating on the substrate. Examples of such buffing aids include copper phthalocyanine having a CAS number of 147-14-8, Permanent Red pigment from Magruder Color Company Inc., Elizabeth, N.J., Rose Bengel Stain having a CAS number of 632-69-9, Furnace Black carbon particles having a CAS number of 1333-86-4, Azure B dye having a CAS number of 531-55-5, Methyl orange dye having a CAS number of 547-58-0, Eosin Y dye having a CAS number of 17372-87-1, New Fuchin dye having a CAS number of 569-61-9, and ceramic particles such as Zeeosphere particles from 3M Zeelan Industries, MN.

Surprisingly and advantageously, the present invention provides a substantially pure coating without a binder. For purposes of a present invention, a material acts as a binder if it is the means of attaching the particle to the substrate. Thus, a composition to be coated is considered to not contain a binder if 20 g of the composition stored for 3 days at a temperature of 25° C. and relative humidity of 40% does not agglomerate (i.e., a powder in a vial would not flow freely).

Mixtures of the above materials can also be buffed to form coatings of desired characteristics. By varying the proportion of the constituents in the mixture very dramatic changes in the surface properties can be obtained. For example, with a mixture of graphite and polyvinylidene difluoride, surface resistance can be varied from $10^3$ Ω/□ to $10^{11}$ Ω/□ by varying the ratio of the materials. As the above example shows one can prepare electrically insulating, electrostatic dissipating or electrically conducting coating with the mixture just by varying the composition easily. Further, the optical absorbance of the coating also is varied from about 0.1 to 0.5 at the same time. Therefore, coatings of controlled optical or electrical characteristics can be prepared with the present invention.

Preferred buffable powders of the present invention are powders having a Mohs' hardness of between 0.4 and 3 and a largest dimension of less than 100 microns. In another embodiment of the invention, one can mix a powder of "non-buffable" material (i.e., a powder outside of the buffable powder definition) with a "buffable" powder and carry out the buff coating process as described above and produce a coating of the mixture. For example, fine particles of a non-buffable pigmnent can be mixed with molybdenum disulfide and buffed to obtain a colored coating.

In another embodiment of the invention, multilayers of different materials may be coated on a substrate by buff coating in discrete steps with different materials. For example, a graphite coated polyethylene terephthalate ("PET") substrate may be buffed with a semiconducting material such as $MoS_2$, and then overcoated with graphite again to form a PET/graphite/$MoS_2$/graphite structure. The formation of these layers is not limited to only the above example, but may be extended to a multitude of structures that may perform in various modes for example as electrical devices. Preferably, a uniformly colored coating can be prepared in this manner.

Since the coating materials disclosed here are all soft materials with Mohs' hardness less than 2.5, the finished article may need a hard coat over it if is subjected to repeated handling to protect the coating from scratches and other surface damage. A conventional hard coat well known in the art may be applied onto the article in a variety of ways, for example, die coating a water based polyurethane formulation.

The coatings of the present invention initially may not adhere well to the substrate. However, surprisingly, the coatings have been found to adhere very well after aging. Generally, adherence of the coating to the substrate will substantially improve after a few days of coating, depending on the combination of the coating material and the substrate polymer. For example, the combination of graphite coating on a polyester substrate provides excellent adhesion after only about one day, with no heating required.

Preferably, adherence of the coating to the substrate is assisted by heating the substrate after the buffing operation to a temperature such that the adhesion of the coating is enhanced, but below the temperature at which the substrate is distorted. Typically, this temperature is between about 10° C. below the softening temperature of the polymer of the substrate to the softening temperature of the polymer of the substrate. The coated substrates of the present invention exhibit an amazingly uniform appearance, and surprisingly the coatings applied with the low energy process as described herein are highly adherent to the substrate. The adherence of the coating to the substrate preferably is such that, after the heat treatment or aging, a piece of 3M Scotch brand premium grade transparent cellotape 610 applied and pressed according to ASTM D-3359 to the surface of the coated substrate with (4.5 lb roller pressure) will not remove the coating material as evaluated by unaided eye visual inspection.

In the present invention the buffing pad is moved in the plane of the substrate parallel to the substrate surface. The orbital motion of the pad in the present invention is carried out with its rotational axis perpendicular to the substrate or web. Thus, the pad moves in a plurality of directions during the buffing application, including directions transverse to the direction of the web in the case where the web is moving past the buffing pad.

A preferred process is characterized by the following: a clutched off-wind station for a roll of base material, a powder feed station that presents materials to be buffed onto the web base material, a buffing station, a pacer drive station which drives the web at a regulated speed, and a clutch driven take-up roll. The system also includes various directing and idler rolls and may also include a post-buffing wiping apparatus to clean excess materials on the buffed web surface. The system may also include a thermal device to improve fusing of materials buffed to the web.

Surprisingly it has been found that very thin coatings of substantially dry particles may be obtained by buffing the particles on a nonporous polymer substrate at a pressure of less than about 30 g/cm$^2$ with an applicator which moves in an orbital fashion (preferably random orbital fashion) parallel to the surface of the substrate. This buffing operation is carried out at a temperature below the softening temperature of the substrate. Optionally the substrate may be heated after the buffing operation to a temperature up to the softening temperature of the polymer of the substrate to assist in adhesion.

Before the heating of the coating to improve adhesion, the coating may be transferred onto an adhesive substrate by bringing the adhesive in contact with the said coating and removing the coating. Thus, for example, a pre-determined pattern may be imparted to the coating by removing only the desired portion of the coating using a patterned adhesive. Subsequently, the coating can be heated to increase the adhesion in the desired regions. Alternatively, the coating may be heated in a desired pattern with a heat roller with a raised pattern that comes in selective contact with the coating, and the unheated areas may be subsequently removed with the aid of an adhesive or tacky substrate.

Applicator pads for use in the present invention may be any appropriate material for applying particles to a surface. For example, the applicator pad may be a woven or non-woven fabric or cellulosic material. Alternatively, the pad may be a closed cell or open cell foam material. In yet another alternative, the pad may be a brush or an array of bristles. Preferably, the bristles of such a brush have a length of about 0.2–1 cm, and a diameter of about 30–100 microns. Bristles are preferably made from nylon or polyurethane. Preferred buffing applicators include foam pads, EZ Paintr® pads (described in U.S. Pat. No. 3,369,268, incorporated herein by reference), lamb's wool pads, 3M "Perfect it" pads, and the like.

The buffing applicator moves in an orbital pattern parallel to the surface of the substrate with its rotational axis perpendicular to the plane of the substrate. The buffing motion can be a simple orbital motion or a random orbital motion. The typical orbital motion used is in the range of 1,000–10,000 orbits per minute.

The thickness of the buffed coating can be controlled by varying the time of buffing. Generally, the thickness of the coating increases linearly with time after a certain rapid initial increase. The longer the buffing operation, the thicker the coating. Also, the thickness of the coating can be controlled by controlling the amount of powder on the pads used for buffing. Finally, the thickness of the coating can be controlled by controlling the temperature of the substrate during coating. Thus, coating operations carried out at higher temperature tend to provide thicker coatings. In contrast, if the coating is carried out very near the softening temperature of the substrate, it may be difficult to obtain a very uniform coating. Thus, it is preferred to carry out the coating process at an ambient temperature that is less than 10 degrees C. less than the softening temperature, and more preferably less than 20 degrees C. less than the softening temperature of the substrate. For purposes of the present invention, "softening temperature" is the temperature at which a material that does not perceptively flow changes to a material that exhibits plastic flow properties.

The present continuous web process is capable of producing coatings with unique characteristics that offer substantial utility to many markets. The process involves application of powder materials to a web base substrate with a lateral "buffing" action. Coatings thus produced may have various electrical, optical and decorative features. Surprisingly high quality thin coatings can be consistently prepared by this simple, dry, solventless process. One area of application involves static dissipation, particularly for electronic packaging. A unique feature includes the ability to thermoform these materials without loss of static dissipative properties. This is not the case with vapor coated metalized films commonly used for such applications today. Another application involves static dissipative backings for abrasive products. The coating of the present invention imparts a color and a finish to the substrate that is aesthetically pleasing.

Coated nonporous polymer substrates according the present invention may provide relatively low cost coated materials, and further may provide coated articles wherein the coating has a morphology not previously obtainable. The use of the coated article is of course determined by the nature of the coating applied thereto. For example, articles may be coated with a semiconducting material such as $MoS_2$ or $WS_2$ and used as a mirror.

Because the polymer substrate that is coated may be of any shape and thickness, the present invention makes it possible to now make low cost mirror that are unusual in shape (such as a tear shape, shape of a light bulb, or polyhedral and the like), or even flexible.

Coatings of the present invention may be photosensitive, conductive, writeable or printable, abrasive, ultraviolet light absorbing, electrically resistive, electrical insulating, static dissipating, thermal conducting, thermally insulating, barrier coating, anti-static, catalytic, photocatalytic, insulative, semiconducting, semi-metallic, lubricating, anti-blocking, anti-fungal, UV absorbing, UV blocking, microwave absorbing, optically reflecting, decorative, radiation absorbing and radiation reflecting. Coatings also may be used to modify the surface energy of the substrate, such that the substrate exhibits any selected surface energy. For example, a low surface energy coating may be desired to create a release coating. A high surface energy coating would increase the wettability of the surface of the substrate, and could be used, for example, as an anti-fogging coating or used as a writable surface for water-based ink.

Coatings of graphite with megaohm/□ range of surface resistance can be made conveniently with the method disclosed. Such thin semi-transparent conducting coatings are difficult to manufacture with consistent properties with physical vapor deposition and other similar methods. For example, such graphite coatings can be used in microwave applications, optical applications and certain electrical applications.

Low secondary electron emission materials allows high electrical fields in devices whose operation is limited by electrical breakdown. The secondary electron emission yield, $\delta$ is the average number of secondary electrons emitted from a bombarded material for every incident primary electron. Molybdenum disulfide, tungsten disulfide and graphite have very low secondary electron emission yields. In the applications where high electric fields are needed between two closely spaced regions, the performance can be improved by having coatings of the above materials to moderate the electrical breakdown of the air in between the said regions. In addition to the low $\delta$ values, the coatings are environmentally very stable as well.

DETAILED DESCRIPTION OF THE DRAWING

Figure 2:
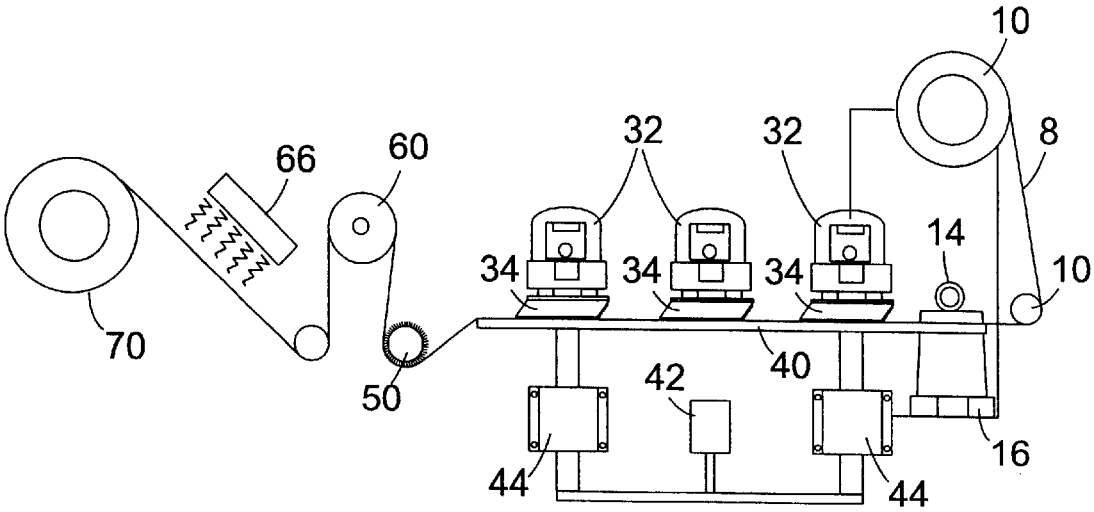
FIG. 2 is a side view of a web coating line of the present invention.

A preferred web coating station of the present invention is shown in FIG. 1 and FIG. 2, where buff process is a clutched off-wind station 10 for a roll of base material, a powder feed station 12 that presents materials to be buffed onto the web base material, a buffing station 30, a web pacer drive station 60 which drives the web at a regulated speed, and a clutch driven take-up roll 70. The system also includes various directing and idler rolls (not shown) and may also include post buffing wiping means for non-buffed web surface and/or a thermal device to improve fusing of materials buffed to the web.

The web coating station comprises a powder dispensing station 12, the buffing station 30, the web wiping station 50 and an optional thermal fuser unit 66. A 30:1 gear reduction was added to the web pace drive system 60 to provide for more precise control of slower web speeds. Most controls are independent of each other to allow for maximum flexibility in determining process control parameters.

Powdered materials to be "buffed" to the web 8 are deposited on the web from a feeder system 12 that has considerable scope in its delivery capability. Precise control of delivery rate of powder to the web is required as, in many cases, coating weights are extremely low, such that in the case of clear films, substantial clarity is retained after the buff coating process.

Feeder system 12 consists of tube 14 with a powder reservoir 16 attached, and a helical brush (not shown) mounted inside the tube. The brush is coupled to a geared motor drive (not shown).

The powder feed preferably has two timers controlling the rate and duration of rotation of powder reservoir 16. Materials are loaded into reservoir 16 that is mounted on the powder feeder. The reservoir may contain a tube mounted within a tube. Both tubes contain orifices to dispense powders. At least one orifice, or set of orifices, is situated above web 8 to distribute the powder in desired concentration across the width of the web.

A mesh screen may be included between the tubes to aid in controlling powder dispensing or alternatively powder may be dispensed though the mesh alone.

Alternately a modified vibratory feed may be employed in dispensing powder. For example, Model F-TO, from FMC Corporation, Homer City, Pa. was used. This vibratory feed may be modified to change it from a "Feed" to a true vibrator. The biased spring action of the vibrator may be changed to align vertically to shake the powder back and forth in the dispensing tube, thereby avoiding a "packing" of the powder. The vertical component of the vibrator action will be identical in both stroke directions.

The rotary buffing action is parallel to the web surface and is accomplished by an orbital sanding device 32 that has been modified to accept buffing pads 34 of specific configuration and materials. This is effected in the process prototype by a succession of three air-driven orbital sanding devices 32 and associated buffing pads 34.

Alternatively, an electric orbital sander such as Black and Decker model 5710 with 4000 orbital operations per minute and a concentric throw of 0.1 inch (0.2 inch overall) may be used. Preferably, the concentric throw of the pad is greater than about 0.05 inch (0.1 inch overall). The air powered orbital sanders used in the process prototype have operational speeds and concentric throw similar to the Black and Decker model 5710 and are from Ingersol-Rand, Model 312 with a free speed of 8000 operations per minute at 90 psi air pressure. With reduced air pressure supplied and increased application pressure the actual operating speeds are in the 0 to 4000 operations per minute range. The three sanders are fed from a common air line (not shown) connected to an adjustable 0 to 100 psi air regulator (not shown) which allows the operator to adjust the buffing speed. There is an on-off air control to actuate these sander/buffers. All of the sanders described have a rectangular orbital pad of approximately 3½ inches×6 inches. On the web buffing operation the web is moved with the shorter side of the buffing pad parallel to web direction. Thus, the 6 inch length of the buffing pad is transverse to the machine direction.

On the process prototype, the three orbital sanders 32 are fixed in position. Below these sanding devices is a smooth plate 40 that can be driven upward to sandwich the web between the buffing pads and the plate, thus applying buffing pressure to the web. Alternatively, plate 40 may be fitted with a heating device to raise the temperature of the substrate while it is being buffed. A precision air pressure regulator, 0 to 50 psi, supplies air to an air cylinder 42 that is connected to the plate to drive it upwards. The plate weight is compensated by air pressure such that at approximately 35 psi pressure the plate applies minimum (near zero) pressure to the web and buffing pads. At 50 psi, the pressure applied to the web is equivalent to the pressure that would be applied in normal sander operation where the weight of the sander plus a few pounds of downward hand pressure is used. The reason for this type of pressure is that the buffing process does not require high pressures to be applied to the web to achieve the desired results. Excessive pressure can damage the web surface including such defects as scratches and melting or warping the web from the heating affects of friction. Generally, excessive pressure of the sanders/pads to the web does not produce a uniform coating of the web.

Two precision guide bearings assist in maintaining the plate travel vertically and stabilizing the plate such that buffing action and energy is not lost in plate movement. An on-off air control allows the operator to actuate the plate.

The orbital sanders 32 used on the process are used to buff the web. No abrasive material is used. The lower orbiting platen of the sander is modified to accept a buffing pad 34 that may also be modified. The buffing pads 34 are obtained from "EZ PAINTR", Wisconsin and are described in U.S. Pat. No. 3,369,268. They are approximately 8 inch long and 3½ inch wide and are a laminate construction of a thin metal backing, a ½ inch thick layer of open-celled polyurethane foam with an active surface of soft, very fine, densely piled nylon bristles 3/16 inch thick. These pads are designed and marketed as a paint applicator. The pads are modified such that they can be easily mounted to the orbital sanders. The process design has included the dimensional ability to increase the lateral stroke of the Ingersol-Rand sanders to ½ inch (1 inch overall).

Preferably, grooves of approximately ⅛ inch wide and 1½ inch long are cut into the leading edge bristles of pad 34 in the web travel direction to facilitate the incorporation into the pad 34. The grooves were spaced approximately ⅝ inch apart creating a comb-like appearance to the lower pad surface. Optical scanning of buffed web, which was produced with this pad, showed very even coating weight with no apparent variation across the web. Additionally, pad 34 may be modified by bending the leading edge of the pad upward to produce a more gradual interface of bristles to web surface. This was incorporated in the "comb" style pad. These modifications to the pad to convert it to a buffing pad were only required on the first pad employed in the process. Subsequent pads in the process were not modified as they primarily finish out the buffing process.

Alternatively, a stationary pad may be mounted between the orbital pads and the powder dispenser. With a stationary pad, the dispensed powder was applied onto the web quickly before the powder had a chance to move around, assuring that the excess powder. was kept on the substrate.

A paint roller 50 was provided prior to the pacer roll 60 to wipe any excess powder from the surface of the buffed web 8.

The pacer roll 60 was knurled on its drive surface. Most webs to be buffed did not include adhesive. The potential for the knurls to scratch the web surface existed. The pacer roll 60 was coated with rubber to alleviate this problem.

It was discovered that the application of heat energy to the buffed web could improve the bonding of some of the materials applied to varying base materials. A 1000-watt radiant heater 66 was added to the process between the idler roller 64 and the wind-up 70. The power can be adjusted by use of a variable transformer to adjust the energy input to the web 8 which is dependant on the specifics of the web and buffing materials and the process speed. Other methods of heat input to the web could also be applied such as an oven or a heated roller in contact with the web. Many webs that are buff coated result in being conductive on their surfaces. Direct application of electrical currents to conductive webs will also produce the desired heating affect, providing high efficiency heating because the energy is generated in the coating itself, directly at the desired point of application. The actual current draw of this heating process is a direct readout of the conductivity of the web and can be used for process monitoring and control.

For conductive coating such as graphite, any method that specifically heats the conductive layer can also be employed. For example, microwave or radio frequency ("RF") energy may be used to heat the conductive layer for fusing.

Mixtures of graphite (Asbury M850) and polyvinylidene difluoride (PVDF) of various ratios from 0% to 100% of graphite were buffed with Speed Painter® pads on polyester substrates for same duration.

Figure 3:
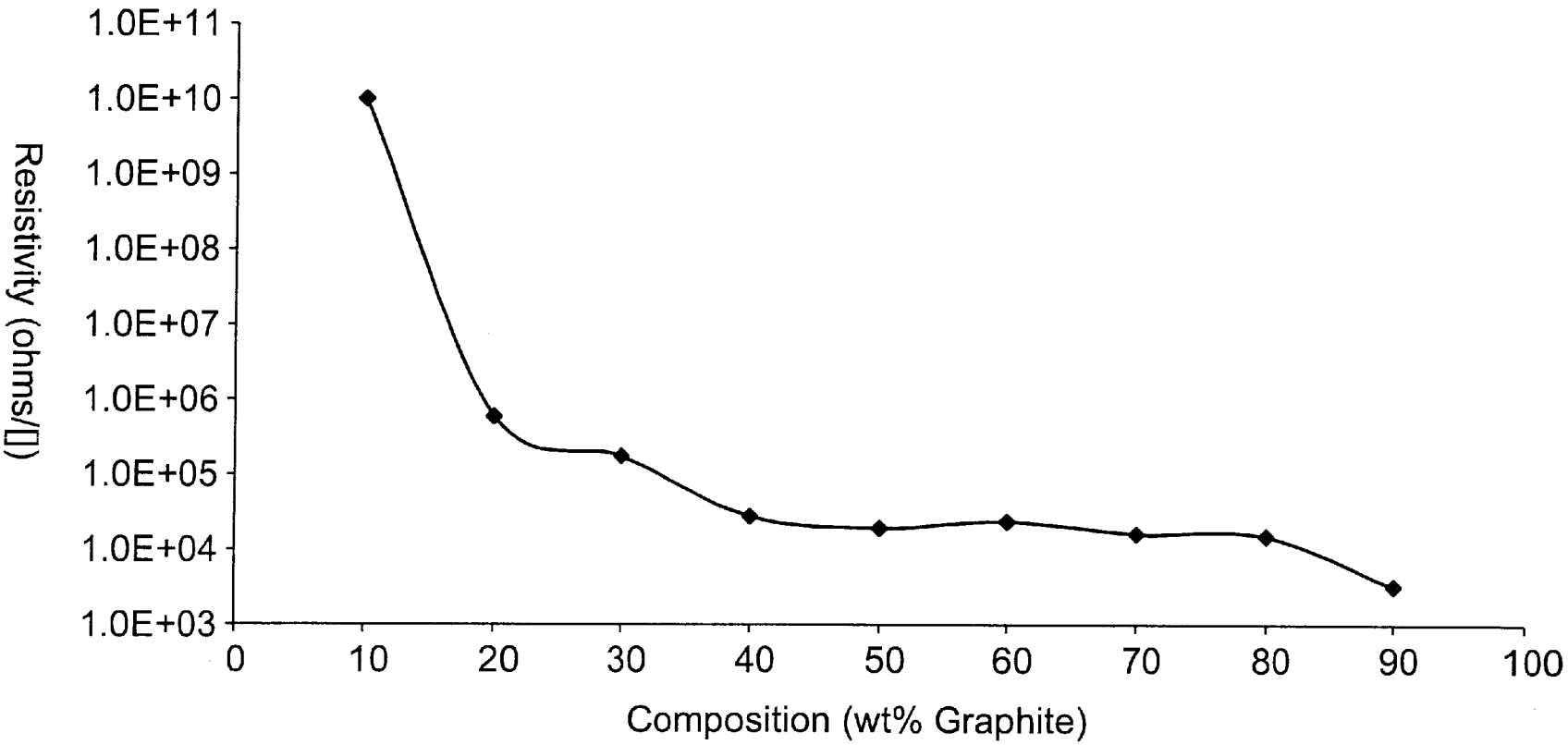
FIG. 3. is a graph showing resistivity of vs composition of a web that has been buff coated in accordance with the present invention.

The sheet resistance (Rs) and the optical transmission (T%) of the above samples were measured. FIG. 3 shows the sheet resistivity Rs (Ω/□) versus the graphite content. The sheets' resistance varies from $10^3$ Ω/□ to $10^{10}$ Ω/□ spanning from conducting to insulating layers. Thus, the resistivity of the sheet may be varied by selection of the mixture of the powders to be applied to the substrate.

Figure 4:
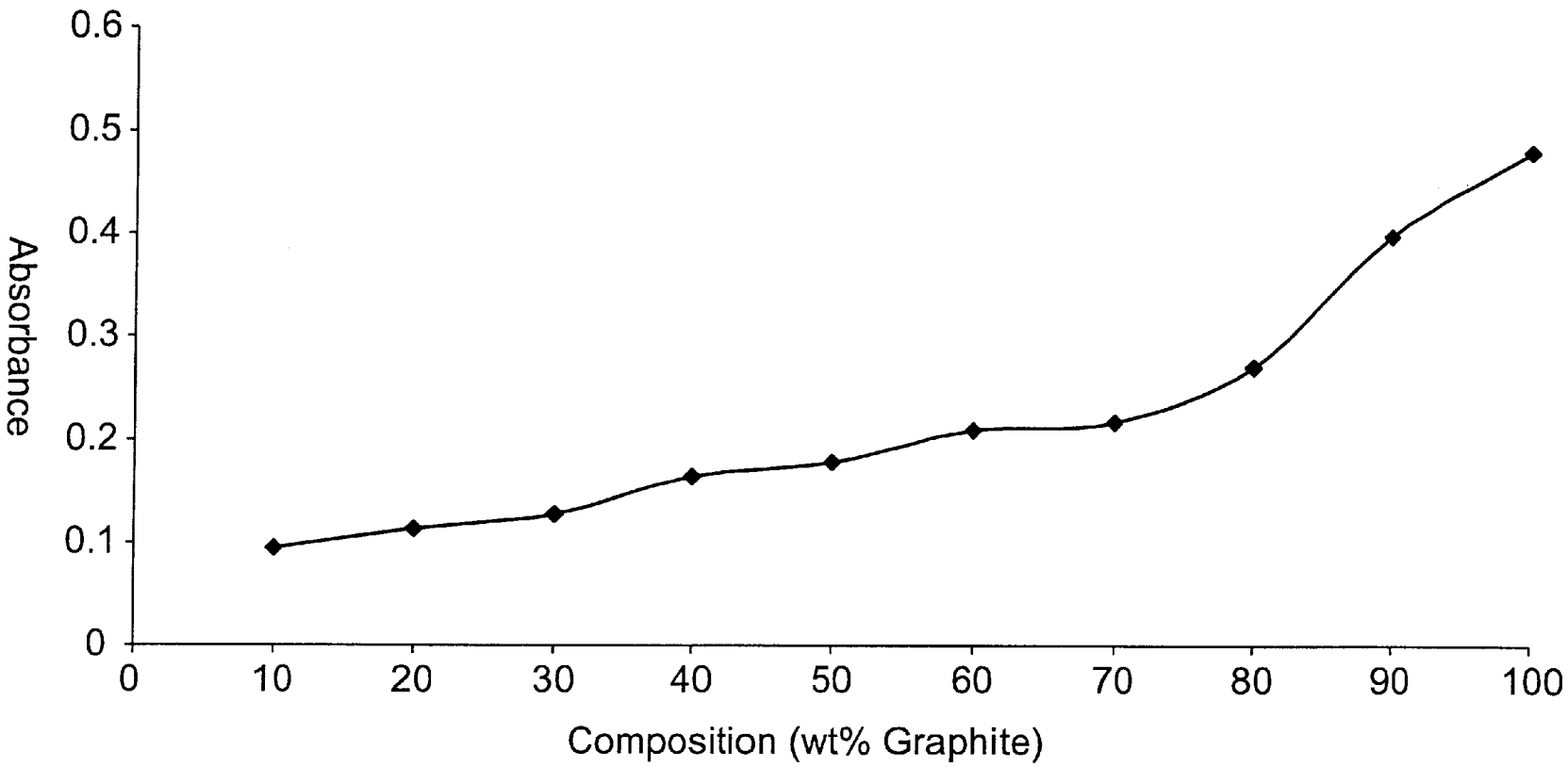
FIG. 4. is a graph showing absorbance vs composition of a web that has been buff coated in accordance with the present invention.

FIG. 4 shows the optical absorbance of values for the same series of samples. The optical absorbance has a five fold variation. Relatively transparent films with static dissipative properties (Rs~$10^8$–$10^{10}$ Ω/□) can be thus prepared on polymeric substrates.

The following non-limiting examples are provided to illustrate the present invention. Unless otherwise indicated, all parts and percentages are by weight and all molecular weights are weight average molecular weights.

EXAMPLES

Example 1

Corona treated 1 mil polypropylene film obtained from MOBIL was buff coated with graphite using a foam pad or hand wiped with a KIMWIPE. The sample was then heat treated in an oven at 120° C. for various period of times in air. The adhesion of the film before and after heating was tested with 3M SCOTCH brand premium grade transparent cellotape 610 according to ASTM D-3359.

The untreated and unaged coating peels off cleanly (1:1 transfer) with the cellotape while the sample heat treated for 1 min or more remains adhered to the polypropylene substrate. This is remarkable since graphite is a layered compound that would be expected to cleave easily at the interface of the coating with the substrate. The treated coatings were resistant to common solvents such as isopropyl alcohol. A sample immersed in heptane for a week did not show any loss of graphite in comparison to a reference sample kept in air as judged by optical transmission.

Two types of other tests were done to confirm the mechanical integrity of the graphite coatings. First, the resistance across a straight line was measured at 1 inch intervals using an Ohm meter with the two probes placed symmetrically across the line 0.25 inch apart. Then the sample was folded along the straight line and creased with fingers forcefully making sure to form a crease right across. The graphite coating was on the outside surface, and was rubbed heavily on during the creasing. The measurements were repeated after creasing. This process was repeated on three creases.

The maximum change in resistance was two fold indicating that the conductive characteristics was not altered significantly in the scale of $10^3$ to $10^5$ Ω/□.

This was confirmed in another test where a sample was crumpled by hand vigorously and the surface resistance was measured before and after crumpling. It remained unchanged at $10^5$ Ω/□. The surface resistance was measured with a PROSTAT Surface Resistance & Resistivity Indicator Model PSI-870.

The optical transmission curves on graphite coated polymers show that the response is nearly flat from 500 nm to 2.5 μm. For a typical graphite coating buffed manually for 30 seconds, the optical transmission is nearly 60% in the above region of wavelengths.

The buff coated graphite on polyethylene produced a thicker coating than with polypropylene. Thicker coatings are conductive ($R_s \leqq 10^3$ Ω/□) but nearly opaque to visible light. The polyethylene can be heat treated at a lower temperature and in a shorter time to improve the coating adhesion than in the case of with polypropylene.

Example 2

Graphite was hand wiped on polyester (MOBIL), polycarbonate (GE LEXAN) and polyimide (DU PONT PYROLUX) using EZ Paintr® painting applicator, and was found to give excellent finish. These substrates were not initially corona treated. The adhesion was not improved to the extent that it did with polypropylene. However, we observed some increase in adhesion with heat treatment as shown by the "tape test."

Example 3

Graphite was buff coated on both sides of 3M microstructured reflective sheeting to form conductive coatings.

Example 4

A 40 mil thick PETG sheet was thermoformed into hemisphere of diameter 14 inch and the resulting convex surface was hand buffed with $MoS_2$ to form a wide angle surveillance mirror. The backside of the mirror was spray painted with a black paint to trap the transmitted light through the mirror to avoid multiple reflections. Alternatively, the concavity of the mirror may be sealed off with a planar black surface to trap the refracted light. The mirror was hung from the ceiling in an office area and kept there for about one year without a protective coating. A thin transparent hard-coat may be useful on the mirror in practice since the $MoS_2$ is a soft material. Alternatively, the inside surface of the hemisphere can be buff coated with $MoS_2$ to provide a mirror that is less prone to damage due to mechanical abrasion.

Example 5

The adhesive side of a Tegadem™ medical dressing is patch coated as follows. A pattern was cut into the release liner applied to the adhesive coated surface of the medical dressing, and portions of the release liner corresponding to the adhesive to be coated were removed. Powder was buffed to achieve the desired pattern. The powders were hand buffed using an EZ paintr® Mini-trimmer (a small nylon-bristled pad) or a small sponge pad. Buffing was done for approximately 10 seconds.

Comparative Example 1

The web speed was set to 7 fpm and the Asbury M850 powder was dispensed by setting the delay in the powder dispenser to 2 seconds and the duration of the rotation to 0.2 seconds. The random orbital air sanders were kept motionless by turning off the air supply to them. The platen was raised up such that a 0.56 mil thick PET web is in contact with the pads. Thus, the PET web was coated with graphite powder. The resulting coating had a streaky non-uniform appearance.

Example 6

The web speed was set to 7 fpm and the Asbury M850 powder was dispensed by setting the delay in the powder dispenser to 2 seconds and the duration of the rotation to 0.2 seconds as in Comparative Example 1. The random orbital air sanders were operated at 40 psi of air pressure with the platen raised up such that the web is in contact with the pads. 0.56 mil thick PET web was coated uniformly to yield an optical transmission of 67% at 550 nm. The resulting coating had an excellent appearance of a vacuum deposited metallic coating. The surface electrical resistivity measured using a PROSTAT Surface Resistance Indicator (Model PSI-870) of the coated web was about $10^4$–$10^5$ Ω/□.

Example 7

Figure 5:
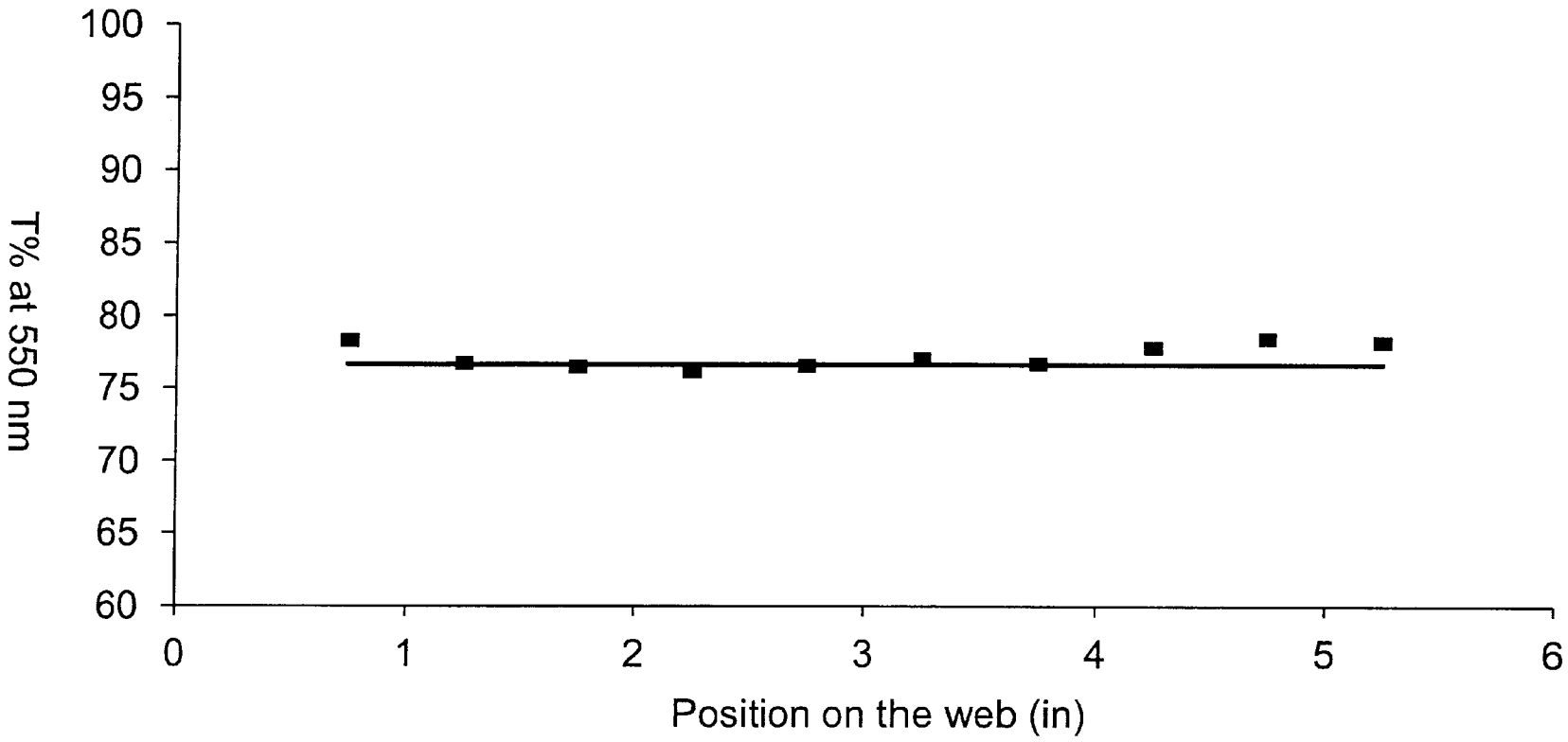
FIG. 5 is graph showing cross-web uniformity of a web that has been buff coated in accordance with the present invention.

The web speed was set to 7 fpm and the Asbury M850 powder was dispensed by setting the delay in the powder dispenser to 2 seconds and the duration of the rotation to 0.2 seconds as in Example 6. The random orbital air sanders were operated at 40 psi of air pressure with the platen raised up such that the web is in contact with the pads. 1 mil thick polypropylene ("PP") web was coated uniformly to yield an optical transmission of 77% at 550 nm. The resulting coating had an excellent appearance of a vacuum deposited metallic coating. The surface electrical resistivity measured using a PROSTAT Surface Resistance Indicator (Model PSI-870) of the coated web was about $10^6$ Ω/□. The crossweb uniformity was evaluated by measuring the percent transmission of light using an optical densitometer at multple points on the web at 550 nm. The results of this evaluation are presented in FIG. 5, which shows that good uniformity is achieved by the method of the present invention.

Example 8

A small piece of graphite coated 2 mil PET as in Example 2 was placed in a domestic microwave oven and the power was turned on for about four seconds, with the power level set to high. The PET melted and crumpled into a black clump. The same treatment with an uncoated PET did not alter its properties visibly. The graphite coated PET can thus be heated in an effective manner in a microwave oven providing a means for heating another article in contact with the coating.

Example 9

A one mil thick film of PET was buff coated with PTFE powder obtained from Dyneon (TF 9205) as in Example 2. The coated film was used as a release liner to release an adhesive tape. A release force of about 100 grams per an inch wide 3M 375 box sealing tape was measured with an IMASS instrument. Measurements of re-adhesion, defined as the percentage of force required to release the adhesive separated from the release liner compared to a pristine adhesive tape indicated excellent adhesion.

Example 10

A PET samples coated as in Example 2 was tested for static dissipation properties. The static decay times of the coated paper backings were measured using a static decay meter (ETS Model 406). The static decay times were measured by charging the samples to + or −5000 V and timing the discharge to 0% cut-off limit (i.e, fully discharged). The graphite coated sample showed exceptional low decay times less than 0.01 seconds.

Example 11

Figure 6:
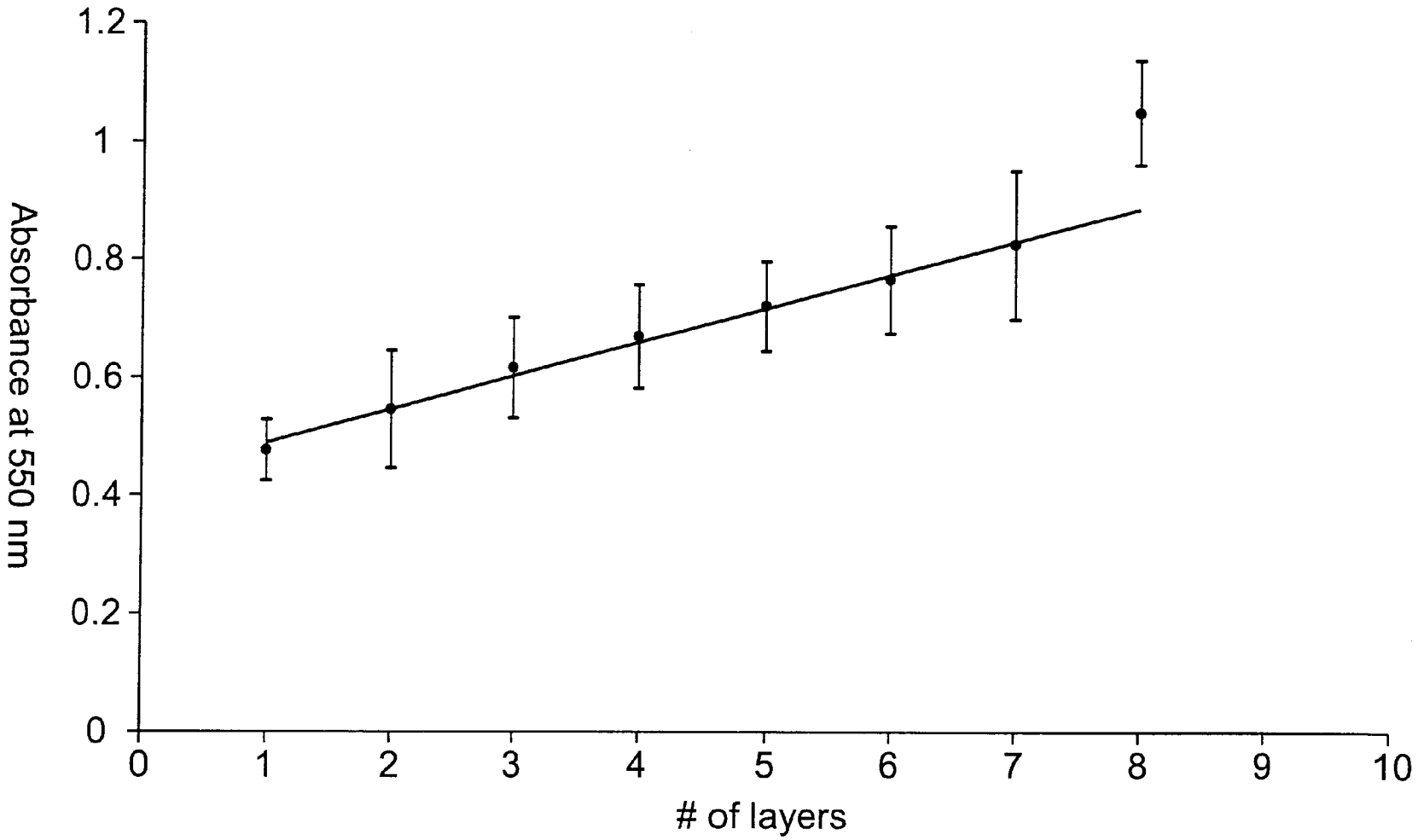
FIG. 6 is a graph showing optical absorbance of multiple layers of coating that have been (web that has been) buff coated in accordance with the present invention.

A 2 mil thick film of polypropylene was buff coated with $MoS_2$ manually as in Example 2 for 30 seconds. This was repeated seven times on the same sample with additional coatings of 30 seconds where the optical absorbance was measured in between each coating step. FIG. 6 shows the optical absorbance at 550 nm vs. number of coating step. A linear relationship between the above two variables was observed indicating that at each step a similar coating thickness is added to the sample.

Example 12

Elemental sulfur powder was buffed manually for 30 seconds on to polyethylene ("PE") film and was found to be attached to the substrate film. A faint yellow tint was apparent in the coating, which was cleared upon a simple heat treatment at 95° C. for 5 minutes in an oven. The sulfur coating on polyethylene is estimated to be about 100 nm thick. The sulfur coating provides some decrease in the UV transmission of the PE as indicated by the optical transmission measurement where the bare PE had a 50% cut off at about 210 nm while the sulfur coated sample had the 50% cut-off at nearly 300 nm.

Example 13

Figure 7:
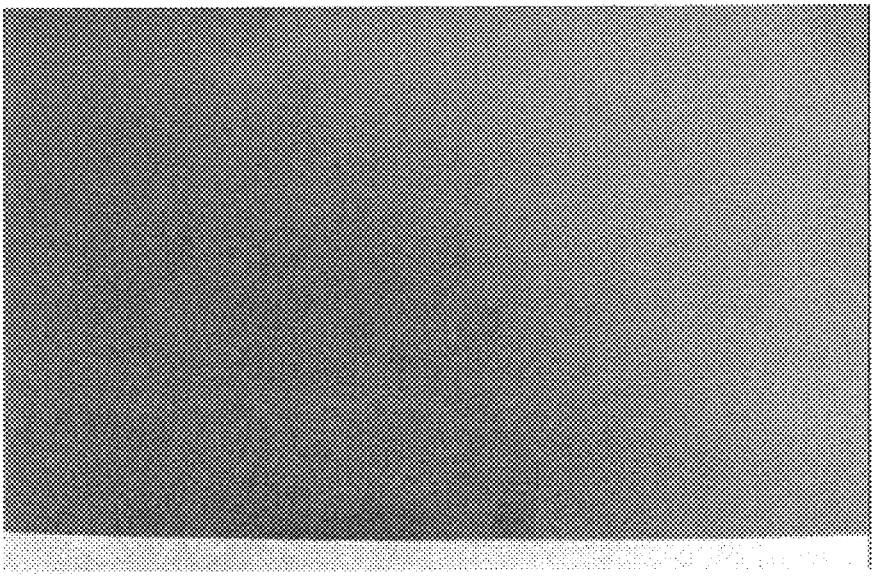
FIG. 7 is a photograph of a buffed graphite film that has been buff coated in accordance with the present invention.

A one mil thick polyester (PET) film was coated with Asbury M850 graphite as follows: a random orbital sander (Finishing Sander Model 450, available form Porter Cable Company, Jackson.Tenn.) was fitted with a soft painting pad (available under the trade designation EZ Paintr from EZ Paintr, Weston, Canada). The pad was saturated with graphite powder by operating the sander on a flat surface with an excess amount of graphite in contact with the pad. The PET film was secured onto a flat surface and some graphite powder was sprinkled on it. The PET was polished with the graphite powder by turning on the random orbital sander fitted with the painting pad and moving it back and forth several times manually. The resulting coating of graphite on PET was very uniform and free of defects. A photograph of this sample is shown in FIG. 7.

Comparative Example 1

A paint roller (1.5" diameter, EZ Paintr) made from the same material as the paint pad in the Example 13 was attached to a 10 mm electric drill (Black and Decker) to be able to rotate the roller around its axis. The paint roller was saturated with Asbury M850 graphite by operating the drill with excess powder in contact with the roller. One mil thick polyester film was secured to a flat surface with masking tape and some graphite powder was sprinkled on it. The paint roller was moved over the PET film back and forth several times with the drill powered on to maximum speed (1350 RPM). The axis of rotation of the roll was kept parallel to the surface of the PET film during the polishing. The resulting coating of graphite on PET was marked with striations and appeared non-uniform.

Figure 8:
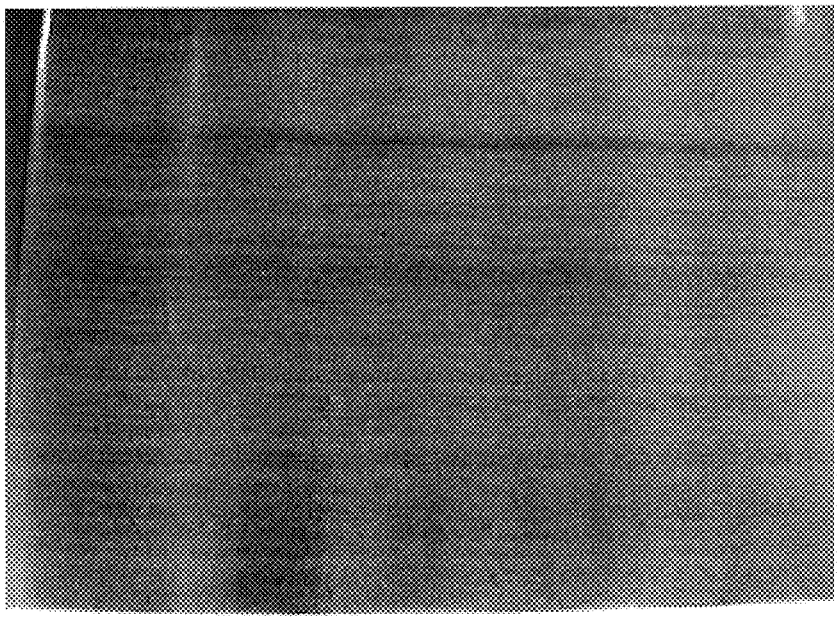
FIG. 8 is a photograph of a comparative example of a film that has been buff coated using a roll operating with its axis in parallel to the web.

Use of various speeds of rotations and combinations of movements with the drill mounted paint roller produced graphite coatings of poor visual appearance. A picture of the coating with best visual appearance is shown in FIG. 8.

Comparative Example 2

A stack of cotton wheels (3" diameter, ½" thick, National Keystone) was mounted on a threaded axle (½" diameter) to form a cylindrical polishing roll of about 4" long. The cotton wheel stack was secured to the threaded axle with two hexagonal nuts at each end. The resulting cotton polishing wheel was mounted onto the drill used in Example 14. The axis of rotation of the cotton roll was as same as that of the drill. A PET film was coated with Asbury M850 graphite using this drill-mounted cotton wheel in the same manner described in Example 14.

The resulting coating had a striated appearance and was non-uniform.

Comparative Example 4

Figure 9:
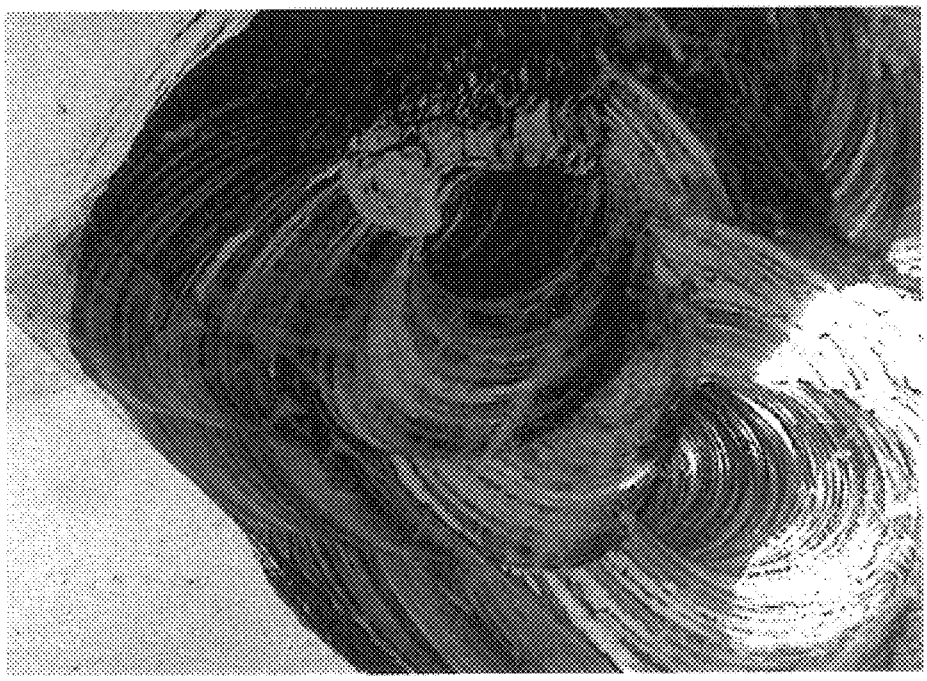
FIG. 9 is a photograph of a comparative example of a film that has been buff coated with an aqueous slurry of particles.

A thick slurry of Asbury M850 was made in water (10 wt %) and used to polish a PET substrate as in Example 13 with a random orbital sander with an EZ Paintr painting pad. The polishing action was with the plane of the pad substantially parallel to that of the substrate. The resulting coating had very non-uniform appearance with obvious swirl marks as shown in FIG. 9.

Comparative Example 4

Figure 10:
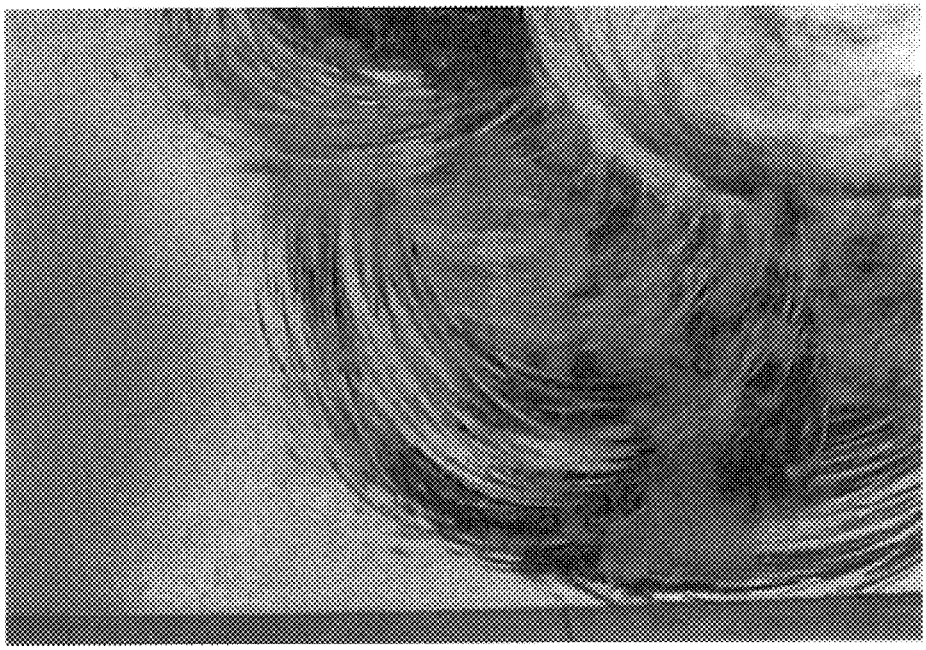
FIG. 10 is a photograph of a comparative example of a film that has been buff coated with an organic liquid slurry of particles.

A thick slurry of Asbury M850 (10 wt %) was made in iso-propyl alcohol and used to polish a PET substrate as in Example 13 with a random orbital sander with a EZ Paintr painting pad. The polishing action was with the plane of the pad substantially parallel to that of the substrate. The resulting coating had very non-uniform appearance with obvious swirl marks as shown in FIG. 10.

Comparative Example 5

A thick slurry of Asbury M850 (10 wt %) was made in methyl ethyl ketone and used to polish a PET substrate as in Example 13 with a random orbital sander with a EZ Paintr painting pad. The polishing action was with the plane of the pad substantially parallel to that of the substrate. The resulting coating had very non-uniform appearance with obvious swirl marks similar to that shown in FIG. 10.

What is claimed is:

1. A method of coating a polymer substrate having a surface with a dry composition comprising particles, said particles having a Mohs' hardness between 0.4 and 3 and a large dimension of less than 100 microns using an applicator pad, comprising buffing an effective amount of said particles on said substrate at a pressure normal to the surface of greater than 0 and less than about 30 g/cm$^2$, said applicator pad moving in a plane parallel to said surface in a plurality of directions relative to a point on the surface such that a uniform coating of said particles is provided, wherein the applicator pad moves in an orbital fashion parallel to the surface of the substrate.

2. The method of claim 1, wherein the particles are selected from carbon black, polytetrafluoroethylene, polyvinylidene difluoride, sulfur, tungsten disulfide, polyetherimide resin, zeolites, I-ascorbic acid, silver chloride, silver sulfadiazine, and various amino acids.

3. The method of claim 1, wherein the particles are selected from graphite, molybdenum disufide, tungsten disulfide, clays and hexagonal boron nitride.

4. The method of claim 1, wherein the particles are selected from a mixture of particles selected from the group consisting of carbon black, polytetrafluoroethylene, polyvinylidene difluoride, sulfur, tungsten disulfide, polytetrafluoroethylene, polyvinylidene difluoride, polyetherimide resin, zeolites, l-ascorbic acid, silver chloride, silver sulfadiazine, and various amino acids; and particles selected from the group consisting of graphite, molybdenum disulfide, tungsten disulfide, clays and hexagonal boron nitride.

5. The method of claim 1, wherein the particles are selected from platelets having a smallest dimension that is less than 10 microns.

6. The method of claim 1, wherein the particles have a Mohs' hardness between about 1–2.5.

7. The method of claim 1, wherein the substrate is selected from polyester, polypropylene, polyethylene, polystyrene, polycarbonate, polyimide, polymethyl methacrylate, polyvinyl chloride, cellulose acetate, silicone, rubber.

8. The method of claim 1, wherein the uniform coating has a thickness of less than 3 microns.

9. The method of claim 1, wherein the uniform coating has a thickness of less than 500 nm.

10. The method of claim 1, wherein the uniform coating has a thickness of less than 200 nm.

11. The method of claim 1, wherein provided that said composition contains no materials in an amount effective to act as a binder of said particles to said substrate.

12. The method of claim 1, wherein the method is carried out at a temperature at least 20° C. below the softening temperature of the polymer substrate.

13. The method of claim 1, further comprising the step of applying a subsequent coating over the uniform coating of particles.

14. The method of claim 13, wherein the subsequent coating is a hardness enhancing coating.

15. The method of claim 1, wherein said uniform coating is located at selected regions of the coated surface of the substrate.

16. The method of claim 1, wherein the particles comprise buffing aid particles and exfoliatable particles, wherein the buffing aid particles have a low affinity for the substrate to be coated and a low affinity for the exfoliatable particles.

17. The method of claim 16, wherein the buffing aid particles are selected from the group consisting of encapsulated dye particles, Methyl red dye particles having a CAS number of 493-52-7, Methylene blue dye particles having a CAS number of 75-09-2, Perylene Red pigment, Rhodamine B dye having a CAS number of 81-88-9, Malachite green oxalate having a CAS number of 2437-29-8, and Azure A dye having a CAS number of 531-53-3.

18. The method of claim 16, wherein the buffing aid particles are selected from the group consisting of magnetic toner particles.

19. The method of claim 1, wherein the particles comprise buffing aid particles and exfoliatable particles, wherein the buffing aid particles have at least some affinity for the exfoliating particles.

20. The method of claim 19, wherein the buffing aid particles are selected from the group consisting of copper phthalocyanine having a CAS number of 147-14-8, Rose Bengel Stain having a CAS number of 632-69-9, Furnace Black carbon particles having a CAS number of 1333-86-4, Azure B dye having a CAS number of 531-55-5, Methyl orange dye having a CAS number of 547-58-0, Eosin Y dye having a CAS number of 17372-87-1, New Fuchin dye having a CAS number of 569-61-9, and ceramic particles.

21. A method of coating a polymer substrate having a surface with a dry composition comprising particles, said particles having a Mobs' hardness between 0.4 and 3 and a large dimension of less than 100 microns using an applicator pad, comprising buffing an effective amount of said particles on said substrate at a pressure normal to the surface of greater than 0 and less than about 30 g/cm$^2$, said applicator pad moving in a plane parallel to said surface in a plurality of directions relative to a point on the surface such that a uniform coating of said particles is provided, wherein the applicator pad moves in a random orbital fashion parallel to the surface of the substrate.

22. The method of claim 21, wherein the particles are selected from carbon black, polytetrafluoroethylene, polyvinylidene difluoride, sulfur, tungsten disulfide, polyetherimide resin, zeolites, I-ascorbic acid, silver chloride, silver sulfadiazine, and various amino acids.

23. The method of claim 21, wherein the particles are selected from graphite, molybdenum disulfide, tungsten disulfide, clays and hexagonal boron nitride.

24. The method of claim 21, wherein the particles are selected from a mixture of particles selected from the group consisting of carbon black, polytetrafluoroethylene, polyvinylidene difluoride, sulfur, tungsten disulfide, polytetrafluoroethylene, polyvinylidene difluoride, I-ascorbic acid, silver chloride, silver sulfadiazine, and various amino acids; and particles selected from the group consisting of graphite, molybdenum disulfide tungsten disulfide, clays and hexagonal boron nitride.

25. The method of claim 21, wherein the particles are selected from platelets having a smallest dimension that is less than 10 microns.

26. The method of claim 21, wherein the particles have a Mohs' hardness between about 1–2.5.

27. The method of claim 21, wherein the substrate is selected from polyester, polypropylene, polyethylene, polystyrene, polycarbonate, polymide, polymethyl methacrylate, polyvinyl chloride, cellulose acetate, silicon, rubber.

28. The method of claim 21, wherein the uniform coating has a thickness of less than 3 microns.

29. The method of claim 21, wherein the uniform coating has a thickness of less than 500 nm.

30. The method of claim 21, wherein the uniform coating has a thickness of less than 200 nm.

31. The method of claim 21, wherein provided that said composition contains no materials in an amount effective to act as a binder of said particles to said substrate.

32. The method of claim 21, wherein the method is carried out at a temperature at least 20° C. below the softening temperature of the polymer substrate.

33. The method of claim 21, further comprising the step of applying a subsequent coating over the uniform coating of particles.

34. The method of claim 33, wherein the subsequent coating is a hardness enhancing coating.

35. The method of claim 21, wherein said uniform coating is located at selected regions of the coated surface of the substrate.

36. The method of claim 21, wherein the particles comprise buffing aid particles and exfoliatable particles, wherein the buffing aid particles have low affinity for the substrate to be coated and a low affinity for the exfoliatable particles.

37. The method of claim 36, wherein the buffing aid particles are selected from the group consisting of encapsulated dye particles, Methyl red dye particles having a CAS number of 493-52-7, Methylene blue dye particles having a CAS number of 75-09-2, Perylene Red pigment, Rhodamine B dye having a CAS number of 81-88-9, Malachite green oxalate having a CAS number of 2437-29-8, and Azure A dye having a CAS number of 531-53-3.

38. The method of claim 36, wherein the buffing aid particles are selected from the group consisting of magnetic toner particles.

39. The method of claim 21, wherein the particles comprise buffing aid particles and exfoliatable particles, wherein the buffing aid particles have at least some affinity for the exfoliating particles.

40. The method of claim 39, wherein the buffing aid particles are selected from the group consisting of copper phthalocyanine having a CAS number of 147-14-8, Rose Bengel Stain having a CAS number of 632-69-9, Furnace Black carbon particles having a CAS number of 1333-86-4, Azure B dye having a CAS number of 531-55-5, Methyl orange dye having a CAS number of 547-58-0, Eosin Y dye having a CAS number of 17372-87-1, New Fuchin dye having a CAS number of 569-61-9, and ceramic particles.

* * * * *